United States Patent [19]

Lane et al.

[11] Patent Number: 4,655,343

[45] Date of Patent: Apr. 7, 1987

[54] FOLDABLE GARMENT BAG WITH CARRY STRAPS

[75] Inventors: Michael L. Lane; Lowell Whitney, both of Arvada, Colo.

[73] Assignee: Quoin Enterprises, Arvada, Colo.

[21] Appl. No.: 750,870

[22] Filed: Jul. 1, 1985

[51] Int. Cl.[4] ..... B65D 85/18; A45C 9/00

[52] U.S. Cl. ..... 206/287.1; 206/284; 206/287; 224/153; 190/111

[58] Field of Search ..... 206/287, 287.1, 284, 206/280; 190/102–127, 18 A, 111; 224/153

[56] References Cited

U.S. PATENT DOCUMENTS

| | | | |
|---|---|---|---|
| 3,115,959 | 12/1963 | Jaffe | 206/287.1 |
| 3,221,848 | 12/1965 | O'Neil | 206/287 |
| 3,291,266 | 12/1966 | Komroff | 190/1 |
| 3,802,613 | 4/1974 | Droeger | 224/153 |
| 4,236,657 | 12/1980 | Brunton | 224/153 |
| 4,420,068 | 12/1983 | Gerch | 190/102 |
| 4,423,834 | 1/1984 | Rush | 224/153 |
| 4,424,841 | 1/1984 | Smith | 190/102 |
| 4,489,829 | 12/1984 | Myers et al. | 206/287 |
| 4,515,300 | 5/1985 | Cohen | 224/153 |
| 4,566,130 | 1/1986 | Coates | 190/1 |

FOREIGN PATENT DOCUMENTS

| | | | |
|---|---|---|---|
| 16254 | of 1911 | United Kingdom | 190/111 |

*Primary Examiner*—William Price
*Assistant Examiner*—Brenda J. Ehrhardt
*Attorney, Agent, or Firm*—Klaas & Law

[57] ABSTRACT

A flexible garment carrier containing accessory pockets capable of accepting clothing which is not pre-folded and then capable of being folded in a manner to form an article of luggage that will fit under an airline seat, or overhead aircraft compartment or be hung in a closet.

14 Claims, 4 Drawing Figures

FOLDABLE GARMENT BAG WITH CARRY STRAPS

BACKGROUND OF THE INVENTION

Travelers frequently use a carry-on garment carrier in order to arrive at their destination with wrinkle-free clothes, and to avoid the time consuming delays of checking and picking up checked luggage. The proliferation of passengers with carry-on luggage has led the airlines to provide closets for hanging garment carriers and closable overhead compartments suitable for storage of carry-on items. These storage spaces, however, are often inadequate to hold all the carry-on articles passengers are likely to have. Specifically, pasesngers who are among the last people to board may find all the closets and overhead compartments filled, leaving only the option of storing carry-on items under the seat in front of the passenger or checking the items with the flight attendants.

Previous attempts by others have not successfully addressed all of these problems. It does not appear that anyone has provided a carry-on luggage article that was configured like a garment carrier and could also be configured to store under an airline seat. Many attempts have been made to combine a garment carrier with other carrying cases, such as described in Shapiro U.S. Pat. No. 4,206,835 and Ekeson U.S. Pat. No. 4,729,038; and to provide a garment carrier that is convenient to carry, such as Tabor et al. U.S. Pat. No. 4,062,429 and Rosenblum U.S. Pat. No. 3,958,675; and various other combinations Komroff U.S. Pat. No. 3,291,266 and Foge U.S. Pat. No. 3,917,038.

It is an objective of the present invention therefore to address the problem of providing travelers with a garment carrier that can carry a suit or dresses and accessories which can also be carried on an aircraft and can be stored under an airplane seat when necessary. Further, the present invention is intended to achieve the objective of providing an article of luggage that contains specialized pockets to carry items likely to be needed in addition to the clothes in the garment carrier.

BRIEF SUMMARY OF THE INVENTION

The present invention provides an article of luggage that combines the features of a flexible garment carrier with accessory pockets, and attachments for convenient carrying, into an article of luggage capable of being carried onto airline airplanes and either hung as a garment bag, stored in an overhead compartment or stored under an airline seat. The garment carrier article, described in greater detail hereinafter, consists of front and rear panel members connected by a flexible side wall member, and can be of a generally rectangula shape, or preferably with an arcuate top portion along the shorter dimension of the rectangle, the entire carrier being adapted to completely receive articles of clothing that are hanging on a standard hanger. The side wall is provided with closure means that allows access to the interior space of the garment carrier. Additionally, a first pocket with pocket opening means or closure means are attached to the garment carrier for storing articles other than hanging clothing and additionally provided with specialized pockets or receiving means which are provided for carrying articles such as a pair of shoes, which are located as further described herein, or adjacent the edges of the top of the carrier when the carrier is rectangular in configuration. The garment carrier article of the present invention is designed so it can be folded into a compact rectangular shape along predetermined creases so that will fit under an airline seat. The garment carrier further has a hand grip for carrying as conventional luggage and one or two adjustable shoulder straps for carrying the luggage over the shoulder when it is in its folded compact configuration. A method of compressing the folded compact configuration is provided in order to adjust the bag for varying the loading capacity of loading and has a semi-rigid panel to form a stable bottom when folded so the bag will be self-supporting when set down. Friction means are provided such that in the compact folded configuration relative movement of the front and rear panels is minimized in order to maintain the shape of the folded bag whether carried by the hand grip or the shoulder straps. Structural means are also provided for counteracting the deforming forces of the shoulder strap when the folded article is carried by one or more shoulder straps.

DESCRIPTION OF THE PREFERRED EMBODIMENTS

Figure 1:
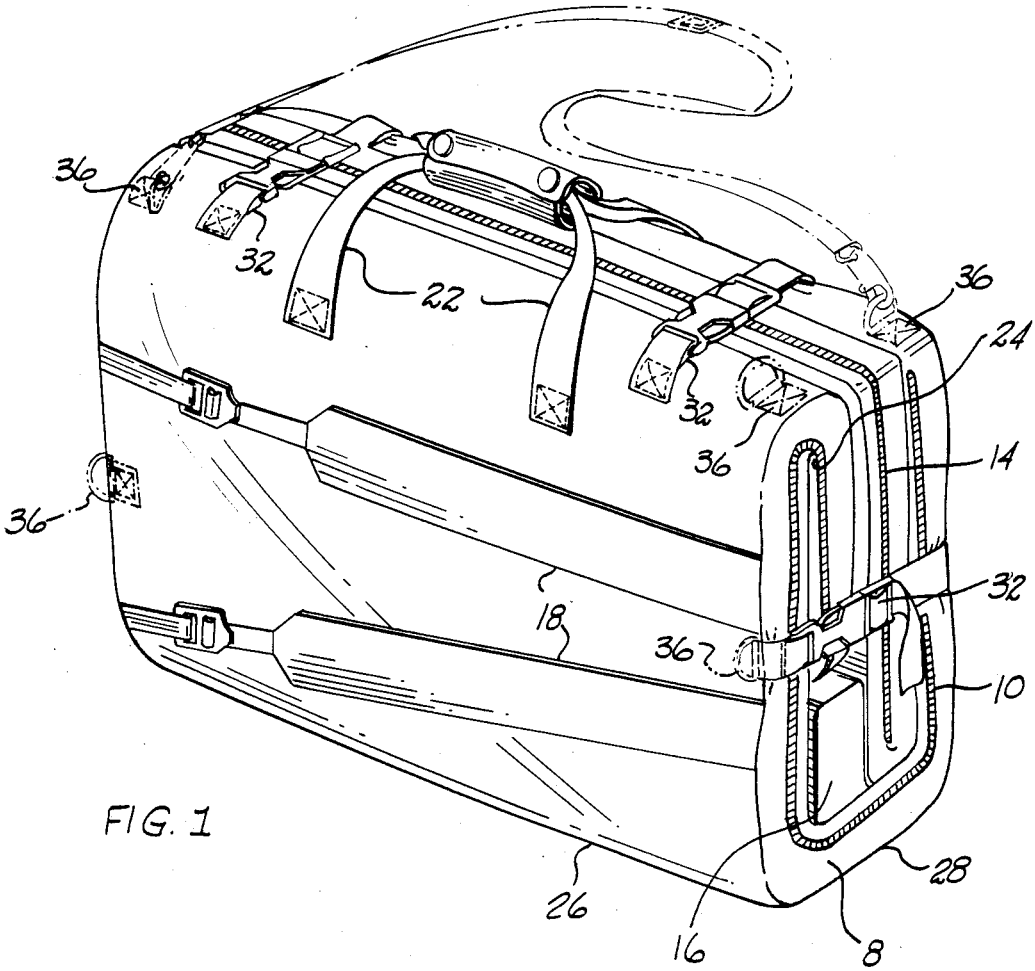
FIG. 1 is a perspective view of the garment carrier in a folded configuration.
Figure 3:
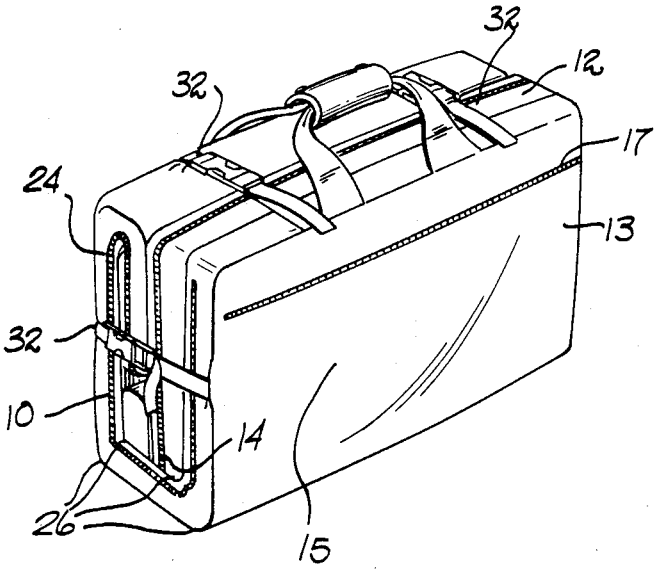
FIG. 3 is a perspective view similar to FIG. 1, but showing the other side of the folded garment carrier.
Figure 2:
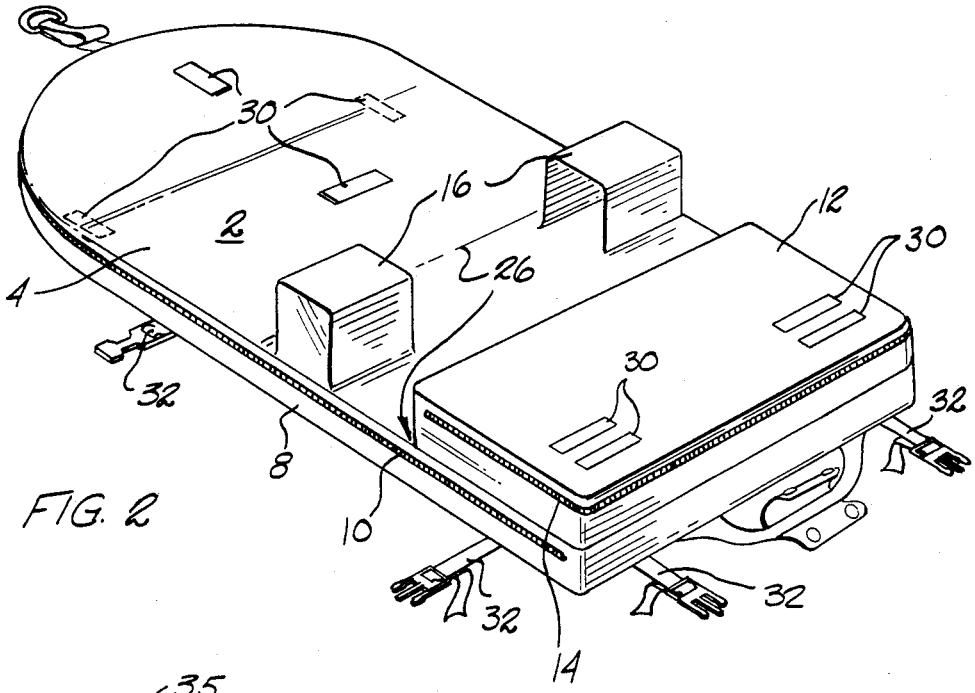
FIG. 2 is a perspective view of the garment carrier in unfolded configuration.
Figure 4:
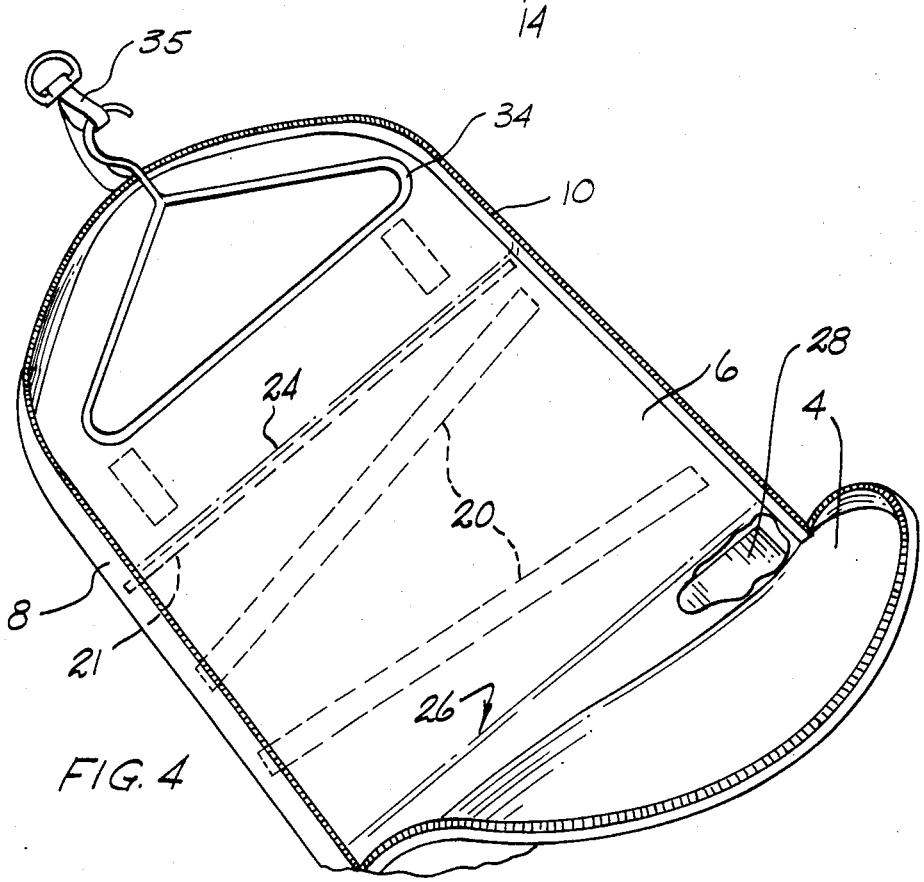
FIG. 4 is a close-up of the top portion of the garment carrier, when unfolded, with closure means partially disengaged showing the interior of the luggage article.

Referring to FIGS. 1 through 4, the luggage article of the present invention comprises a garment carrier portion 2 constructed of a flexible front panel 4, and a flexible rear panel 6, connected by a flexible side wall 8 which contains a closure means 10. This closure means is preferably a zipper which is installed along the two sides and the arcuate top portion of the flexible panels 4 and 6. The rectangular bottom portion of the garment carrier is preferably a continuous wall or attachment or single fold between the front panel 4 and rear panel 6. These items 4, 6, 8 and 10, comprise the garment carrier portion 2 of the luggage. Attached to the top surface and bottom end of the front panel 4 is a first pocket means 12 which has its own pocket closure means 14 which allows access to said pocket means 12, which can be used for storing items necessary for traveling in addition to garments contained in said garment carrier 2. In addition, attached to or integral with the bottom surface 13 of flexible rear panel 6, the luggage article can be provided with second pocket means 15 for small, preferably flat articles, said means also being provided with a closure means 17, which is preferably positioned, as shown, to be opened and closed while the luggage article is in a folded condition (see FIG. 3).

Attached to the mid section of the front panel 4 at a location above the semi-rigid panel 28 which will constitute the bottom of the luggage when in the folded position, are shoe pockets or other receiving means 16 which can be used for carrying a pair of shoes or other articles. The garment carrier 2 with attached pocket means 12 and attached shoe pocket means 16 can be folded to form a top fold crease 24 and bottom fold creases 26 to form a compact rectangular luggage of approximately 20"×13"×8" for convenient storage under an airplane seat. Attached to said rear panel 6 is a suitable carrying means 18 for carrying the luggage over one or both shoulders. Optionally, a single shoulder strap can be employed and fastened similar to the shoulder strap shown in phantom in FIG. 1, or with one or both ends attached to connecting loops 36 (shown in phantom) to stimulate functionally carrying means 18. The luggage contains a structural means 20 or 21 to counteract the forces of said carrying means 18 in order to maintain the rectangular shape of the luggage when it is carried with said carrying means 18 or the alternative carrying means shown. Said structural means 20 or 21 is shown as a compression member installed approximately between the attachment locations of said carrying means 18 and the alternative carrying means. Attached to the midpoint of said top fold crease 24 on said rear flexible panel 6 and to the bottom midpoint of said front panel 4 are devices to form a handle means 22 which can be used as a handgrip when in the folded configuration. Said semi-rigid panel 28 is located near the midpoint of garment carrier 2 between bottom fold creases 26, and, when in the folded configuration, will form a firm bottom to support the luggage in an upright position. Friction means 30, such as hook and loop fabric means, are attached to said front and rear panels 4 and 6 and on said first pocket 12 at approximate locations shown in FIG. 2 such that in the folded position, said friction means 30 contact a corresponding friction means 30 in order to limit the relative lateral motion between said front and rear panels 4 and 6 when the luggage is carried with said carrying means 18 or handle means 22. With this embodiment said garment carrier 2 will accept garments that are on a standard hanger 34 and the top portion of said garment carrier 2 is tapered or arcuate shaped to conform to the general shape of a standard hanger 34 and to allow an internal space for said shoe pocket means 16 when folded on said top and bottom fold creases 24 and 26 to form a compact rectangular luggage.

In addition to the foregoing, fastening means 32 are provided which can be adjusted or fixed at a predetermined length to compress the carrier, when in a folded configuration to form and maintain the compact rectangular shape of the dimensions described.

Further, a strap and loop structure 35 is provided for receiving a standard hanger 34.

It is contemplated that the inventive concepts herein described may be variously otherwise embodied and it is intended that the appended claims be construed to include alternative embodiments of the invention except insofar as limited by the prior art.

What is claimed is:

1. A garment travel bag for holding clothes and accessories while hanging in a vertical fully extended open position and in a closed folded carrying and storage position comprising:

a relatively large size main storage compartment means made of flexible foldable material for receiving relatively large size clothes and having a generally rectangular peripheral configuration with a length and width of sufficient size to receive suit-type clothes and having a main flat outer side wall portion, an upper peripheral outer wall portion, a pair of spaced peripheral outer side wall portions and a bottom peripheral outer wall portion defining a main storage compartment;

a relative large size main cover means made of flexible foldable material for covering and closing said main storage compartment means and being movable between an open position and a closed position relative to said main storage compartment means and having a peripheral size and shape generally corresponding to the size and shape of said main flat outer side wall portion of said main storage compartment means and having a bottommost connecting end portion fixedly associated with said main storage compartment means;

a main compartment closure means mounted along said upper peripheral outer wall portion and said spaced peripheral outer side wall portions of said main storage compartment means and along the periphery of said main cover means for connecting and disconnecting said main cover means to said main storage compartment means in said closed position while enabling movement of said main cover means between said open position and said closed position;

hanger means mounted along said upper peripheral outer wall portion for hanging the garment bag in the vertical fully extended open position;

a relatively small size generally rectangular separate secondary storage compartment means mounted on said main storage compartment means in juxtaposition to said bottom peripheral outer wall portion for storing relatively small size items and having an upper peripheral wall portion extending in generally parallel upwardly spaced relationship to said bottom peripheral end wall portion of said main storage compartment means and a pair of peripheral side wall portions extending generally parallel to and coplanar with said peripheral side wall portions of said main storage compartment means and a bottom peripheral wall portion extending generally parallel to and coplanar with said bottom end wall portion of said main storage compartment means;

a relatively small size cover means for covering said relatively small size storage compartment means and having a size and shape generally corresponding to the size and shape of said secondary storage compartment means and being movable between an open access position and a closed connecting position relative to said secondary relatively small size storage compartment means;

a secondary compartment closure means for connecting said relatively small size cover means to said secondary storage compartment means; and a plurality of longitudinally spaced transverse parallel fold line means for enabling said garment bag to be folded into a rectangular box-like configuration in the folded carrying and storage position and having opposite outer wall portions formed by spaced portions of said main side wall portion of said main storage compartment means, a bottom wall portion formed by an intermediate portion of said main side wall portion of said main storage compartment means, and an upper wall portion formed by said bottom wall portions of said main compartment means and said secondary compartment means and an intermediate portion of said main side wall portion of main compartment means with said upper peripheral outer wall portion of said main compartment means facing downwardly and being centrally located between said upper, lower and side wall surfaces of said box-like configuration;

holding means for holding the garment bag in the folded carrying and storage position; and handle-type carrying means for carrying said garment bag by hand in the folded carrying and storage position and being fixed to said main storage compartment means and being positioned and located along said upper surface in the folded carrying and storage position.

2. The invention as defined in claim 1 and wherein said plurality of longitudinal spaced transverse parallel fold line means comprising:

a lowermost first fold line means located upwardly from said bottom peripheral wall portion of said main compartment means and being located adjacent said upper peripheral wall portion of said secondary storage compartment means for providing a first generally rectangular outer panel portion between said lower peripheral wall portion and said first lowermost fold line means which constitutes a first upwardly extending outer side wall portion in the folded storage and carrying position;

a second fold line means spaced upwardly from said first lowermost fold line means a relatively short distance and being located approximately midway between said upper peripheral wall portion and said lower peripheral wall portion of said main compartment means for providing a second generally rectangular outer panel portion between said first lowermost fold line means and said second fold line means which consitutes an outer bottom panel portion in the folded storage and carrying position;

an uppermost third fold line means spaced upwardly from said second fold line means for providing a third generally rectangular outer panel portion having a size approximately equal to said first generally rectangular outer panel portion which constitutes a second outer upwardly extending side wall portion located in generally parallel relationship to said first outer upwardly extending side wall portion in the folded carrying and storage position; and said uppermost third fold line means being downwardly spaced from said uppermost peripheral wall portion of said main compartment means and further providing an uppermost panel portion which is folded downwardly and located between said first outer upwardly extending outer side wall portion and said second upwardly extending outer side wall portion in the folded carrying and storage position.

3. The invention as defined in claim 2 and wherein said holding means comprising:

laterally extending fastening means extending between said first upwardly extending outer side wall portion and said second upwardly extending outer side wall portion in the folded carrying and storage position for holding said first upwardly extending outer side wall portion and said second upwardly extending side wall in generally parallel juxtaposition with one another.

4. The invention as defined in claim 2 and further comprising:

a pair of back-type carrying strap means for carrying said garment bag on the back of a person and being fixedly connected to said main storage compartment means along said main side wall portion at a location and position thereon such as to extend across one side surface of said folded box-like arrangement.

5. The invention as defined in claim 3 and wherein said handle means being located adjacent the uppermost peripheral side portions of said first upwardly extending outer side wall portion and said second upwardly extending outer side wall portions.

6. The invention as defined in claim 4 and wherein said holding means comprising:

first fastening means on said main cover means opposite said uppermost panel portion and on said main cover means opposite said third panel portion for holding said uppermost panel portion in downwardly extending generally parallel relationship to said third panel portion in the folded carrying and storage position.

7. The invention as defined in claim 6 and further comprising:

second fastening means on said uppermost panel portion and said secondary compartment cover means for holding said uppermost panel portion in closely spaced generally parallel relationship to said first panel portion in the carrying and storage position.

8. The invention as defined in claims 2 or 6 and further comprising:

rigidifying panel means attached to said second outer panel means for rigidifying said bottom wall portion in the folded carrying and storage position.

9. The invention as defined in claim 2 and further comprising:

back and shoulder strap means mounted across one of said first outer side panel means and said third outer side panel means for back and shoulder carrying of said garment bag in the folded carrying and storage position.

10. The invention as defined in claim 3 and wherein:

said laterally extending fastening means comprising a fastener device associated with said handle means; a pair of strap devices located adjacent said handle means and mounted on and extending between said first upwardly extending outer panel portion and said third upwardly extending outer panel portion; and a pair of strap devices mounted on said first outer panel portion and said third panel portion and located on opposite side edges of said first outer panel portion and said third outer panel portion in said carrying and storage position for fastening said side edges to one another.

11. The invention as defined in claim 1 and further comprising:

shoulder-type carrying means for attachment to said main storage compartment means at locations along said upper surface in the folded closed carrying and storage position for carrying said garment bag by shoulder in the folded closed carrying and storage position.

12. The invention as defined in claims 1 or 2 and further comprising:

a pair of oppositely inwardly facing shoe pocket means for holding a pair of shoes and being mounted on said main storage compartment cover means in upwardly longitudinally spaced relationship to said secondary storage compartment means.

13. The invention as defined in claims 1 or 2 and wherein:

said relatively small size cover means having an upper connecting end portion fixedly connected to said upper peripheral side wall portion of said secondary storage compartment means; and said secondary compartment closure means extending about the periphery of said secondary compartment means and the periphery of said secondary storage compartment cover means from opposite sides of said upper peripheral wall portion of said secondary storage compartment means and said upper connecting end portion of said relatively small size cover means and along said peripheral side wall portions and across said bottom peripheral wall portion of said secondary storage compartment means.

14. The invention as defined in claim 2 and further comprising:

a third compartment means mounted on one of said outer panel portions for access in the folded carrying and storage position.

* * * * *